US005332228A

United States Patent [19]

Schultz

[11] Patent Number: 5,332,228

[45] Date of Patent: Jul. 26, 1994

[54] STUD POKER GAME WITH VARIABLE POSITION WILD CARD

[75] Inventor: Phillip C. Schultz, W. Bloomfield, Mich.

[73] Assignee: M P Software Inc., W. Bloomfield, Mich.

[21] Appl. No.: 93,175

[22] Filed: Jul. 16, 1993

[51] Int. Cl.[5] ..... A63F 1/00

[52] U.S. Cl. ..... 273/292; 273/85 CP

[58] Field of Search ..... 273/292, 274, 309, 85 CP

[56] References Cited

U.S. PATENT DOCUMENTS

| | | | |
|---|---|---|---|
| 5,019,973 | 5/1991 | Wilcox et al. | 364/412 |
| 5,022,653 | 6/1991 | Suttle | 273/85 CP |
| 5,100,137 | 3/1992 | Fulton | 273/85 CP |
| 5,118,114 | 6/1992 | Tucci | 273/274 |

OTHER PUBLICATIONS

"According to Hoyle" by Richard L. Frey; 1970 pp. 25, 27, 28 (See Comments).

"Scarne's Encyclopedia Of Card Games" by John Scarne; 1983 pp. 38, 39, 46, 47, 48 (See Comments).

"Scarne's Guide To Modern Poker" by John Scarne; 1979 pp. 226, 232, 236, 237, 238 (See Comments).

"Hoyle's Rules Of Games" by Albert H. Morehead & Geoffery Mott-Smith; 1983 p. 47 (See Comments).

"The Penguin Book Of Card Games" by David Parlett; 1987 pp. 386, 387 (See Comments).

"Jacoby On Card Games" by Oswald Jacoby & James Jacoby; 1986 p. 113 (See Comments).

"Winning Strategies For Video Poker" by Lenny Frome; 1993 pp. 58, 59, 78, 79, 104, 105, 108, 109 (See Comments).

*Primary Examiner*—Benjamin H. Layno

[57] ABSTRACT

An improved stud poker game which requires no decisions from the player after the initial bet is placed. Each hand has one guaranteed wild card that appears at a card position which is predetermined, and shown to the player, before the player's cards are dealt. In addition to the one guaranteed wild card, all like-valued cards in the hand are also wild. Also, there are a number of novel and entertaining ways to determine the wild card position. The game is adaptable to both video play and table play formats.

14 Claims, 7 Drawing Sheets

STUD POKER GAME WITH VARIABLE POSITION WILD CARD

FIELD OF INVENTION

This invention relates to a method for playing a modified stud poker game as a casino game, and more particularly to modified video and modified table stud poker games.

PRIOR ART

The basic game of video poker has been in casinos since approximately 1980 and several variations of this very popular game have appeared. In the basic draw poker game, the player is allowed to inspect five cards randomly chosen by the computer. These cards are displayed on the video screen and the player chooses which cards, if any, that he or she wishes to hold. If the player wishes to hold all of the cards, i.e. stand, he or she presses a STAND button. If the player wishes to hold only some of the cards, he or she chooses the cards to be held by pressing HOLD keys located directly under each card displayed on the video screen. Pushing a DEAL button after choosing the HOLD cards automatically and simultaneously replaces the unchosen cards with additional cards which are randomly selected from the remainder of the deck. After the STAND button is pushed, or the unchosen cards are replaced, the final holding is evaluated by the game machine's computer and the player is awarded either play credits or a coin payoff as determined from a payoff table. This payoff table is stored in the machine's computer memory. Hands with higher poker values are awarded more credits or coins.

In addition to the basic video draw poker game described above, several other variations of video draw poker exist. Currently, the most popular variations include wild cards, which provide an extra degree of volatility to the basic game. The wild cards are typically deuces and a joker, or a combination thereof.

The aforementioned games, without exception, all follow the DRAW format, that is the player views five cards, and then is allowed to discard as many cards as he or she wishes and draw new cards. This, however, is only one form of poker. Other poker games, which do not allow for the replacement of cards, are called STUD poker games. Many such games, all played in table form, are described in books such as "According to Hoyle" by Richard L. Frey, copyright 1970, and one game merits special attention as prior art.

In the game "Spit in the Ocean", as described in the aforementioned book, each of the players at the table receive four cards. Then a fifth card is placed in the center of the table. This fifth card is both common, which means that it is part of each player's individual hand, and it is wild. For example, if the fifth card is the seven of hearts, any other sevens in any player's hands are also wild. STUD poker variations of this game allow for either five rounds of betting, or only one round of betting after all cards are dealt. "Spit in the Ocean" is a STUD game, because each player receives only five cards, but the wild card allows for higher value poker hands which are more interesting to play.

"Spit in the Ocean", however, has never found a niche in Las Vegas or other casinos for two fundamental reasons. Because the last card is always wild, the player knows very little about the value of his or her hand before the final card is dealt. This makes judging the value of hands in progress very difficult, and requires a great deal of skill, or guessing, on the part of the players. This skill, or guessing, manifests itself in the high degree of uncertainty before the crucial wild card is revealed. Secondly, "Spit In The Ocean" has not become a casino table game because of its wild card nature. Table poker operators in casino parlors universally shun "wild card" games, treating non-wild games as the purer and more desirable games for highly skilled players. This leaves an unfilled need for a fast-paced, entertaining wild card table poker game in casinos. Also, neither "Spit In The Ocean" or any wild-card stud game has ever been appeared in a video game version, where the player plays against a payoff table instead of against other players. Given the popularity of wild-card draw video poker games, the omission of a video wild-card stud game creates another unfilled need.

"Spit in the Ocean" is certainly not the only STUD game to fail in casinos. In fact, STUD games in general have proven to be quite rare in video form and five-card STUD games are also rare in table poker parlors. This is a result of the underlying fact that very good, or high quality, hands are very infrequent in non-wild STUD games. (Seven-card STUD table poker is a singular exception to the above trend, since seven cards yield more high quality poker hands.) The video five-card STUD games that have appeared have attempted to solve the above infrequent payoff problem by giving the player chances to win more money or credits on relatively low quality hands; and not by increasing the frequency of more entertaining high quality hands.

One such variation, Double Down Stud, is disclosed in U.S. Pat. No. 5,100,137. In this game, the player views the first four cards of the five card hand, and then has the option to double his or her bet. This provides the player with the advantage of doubling his or her bet on hands where the first four cards already comprise a winning combination. While this feature allows the player financial advantages, it does nothing to help the fact that high quality hands are still exceedingly rare, and therefore does nothing to increase the excitement of the basic STUD game. Double Down Stud also requires significant player skill in order to compete against the payoff table odds.

Another five-card STUD game, Action Poker, is disclosed in U.S. Pat. No. 5,118,114. Here the game gives the player multiple chances to win. The player's hand is evaluated after the second, third, fourth, and fifth cards, so he or she has essentially four chances to win. This formula is similar to Double Down Stud, however, in that it does nothing to help increase the frequency of high quality hands while substituting the opportunities to win on two, three, four and five card holdings.

Perhaps the most popular five-card STUD game currently in Las Vegas casinos is Caribbean Stud Poker as revealed in U.S. Pat. No. 5,022,653. In this table game, the players try to beat the dealer's hand and are paid special bonuses for the rare high quality hands. There are also rules which do not let the dealer compete if the dealer's hand has a rank lower than Ace-King high. This game involves two rounds of betting and requires significant player skill. Like Double Down Stud and Action Poker, however, it pays more for hands of lesser quality rather than increasing the frequency of high quality hands that are universally more entertaining to play.

One very effective way for a five-card STUD game to provide more high value hands is to include wild cards in the game, as is the case with "Spit In The Ocean". As noted above however, "Spit In The Ocean" has features which have kept it from becoming a popular casino game.

According, the inventor has devised a novel game of STUD poker which is adaptable to both video play and table play. This new game overcomes the deficiencies and unfilled needs in the above prior art by introducing, for the first time, the concept of a wild card appearing in a variable position within the hand. Also, other cards in the hand which match to wild card's value are also wild. Thus, from hand to hand, the player will see the wild card at any one of the five card positions. This unique variable position wild card feature lets the player sometimes see wild cards starting at the first card displayed, at other times, see them starting at any of the other card positions. This adds the highly desirable elements of suspense, anticipation and freshness to the game because the player never knows which card position will be the wild card position from one hand to the next. Also, in hands where the wild card is one of the early cards, the player has the added pleasure of seeing the wild card, and any other like-valued cards which are also automatically wild, create high quality hands before his or her very eyes! Additionally, this game requires absolutely no player decision-making or skill. Yet, because of its variable wild card position feature, it is extremely interesting to play. Even skilled poker players would enjoy this game for pure mental relaxation after tension-filled sessions of poker fraught with tough player choices. Finally, since the player always plays against a payoff table, there is no competitive betting among players or against the dealer in the table version. This features creates a much more intimate and friendly table game for players and the dealer alike. Finally, as are apparent in the following claims, the wild card position can be selected in several unique, interesting and entertaining ways.

SUMMARY OF INVENTION

Therefore, it is an object of this invention to provide a uniquely entertaining variation of stud poker which offers a high level of player enjoyment and is extremely easy to learn.

Another object of this invention is to provide a comfortable forum for an unskilled player to play stud poker and to become knowledgeable about the game.

Still another object of this invention is to provide a video poker game variation which assures a level of profitability for casinos which is equivalent to the currently produced family of draw poker video games.

A final object of this invention is to create a game that is adaptable to both the video game and the table game environment.

These and other objectives and advantages of this invention shall become apparent from the following descriptions.

Accordingly, the preferred embodiment described below is a casino video poker game wherein a player places his or her bet into the machine and pushes a button labeled DEAL. After this initial player action, the machine randomly determines which one of the players five card positions will be the wild card position. Through a display means the computer displays this position to the player. For example, card number three might be selected as the wild card position in a given hand. Then the card dealt to the third position is the wild card for the hand, regardless of its value. After the wild card position is determined, the machine deals out the five cards, one at a time to each position.

The card that appears in the pre-determined wild position appears with "WILD" inscribed on the upper right hand corner of the card. At this time, any previous cards of the same value will also immediately be inscribed with a "WILD" label. After which, any further cards that match the wild card value will automatically appears with the "WILD" label already inscribed. The above process is highly entertaining to observe for skilled and unskilled players alike.

Once the hand is dealt, the machine evaluates the hand rank according to Hoyle's ranking of poker hands. Upon evaluation, the player is paid according to a payoff table for winning hands. This payoff could be in credits or coins. At this point, the game is over. To begin a new game, the player places a new bet and again presses DEAL.

A table game version unfolds in basically the same way. The players place their bets, and then the wild card position is determined. The dealer then deals out each player's cards, and upon completion, evaluates each player's hand and pays each player according to a payoff table. A likely difference between the video and table versions is that the table version would very probably use a shoe containing several decks of cards (like blackjack); whereas the video version would probably use one deck of cards and re-shuffle between each hand. Also, a multiple deck game offers players an opportunity to achieve a "five wild cards" winning hand which is not possible in a single deck game.

DETAILED DESCRIPTION OF THE PREFERRED EMBODIMENT

Figure 1:
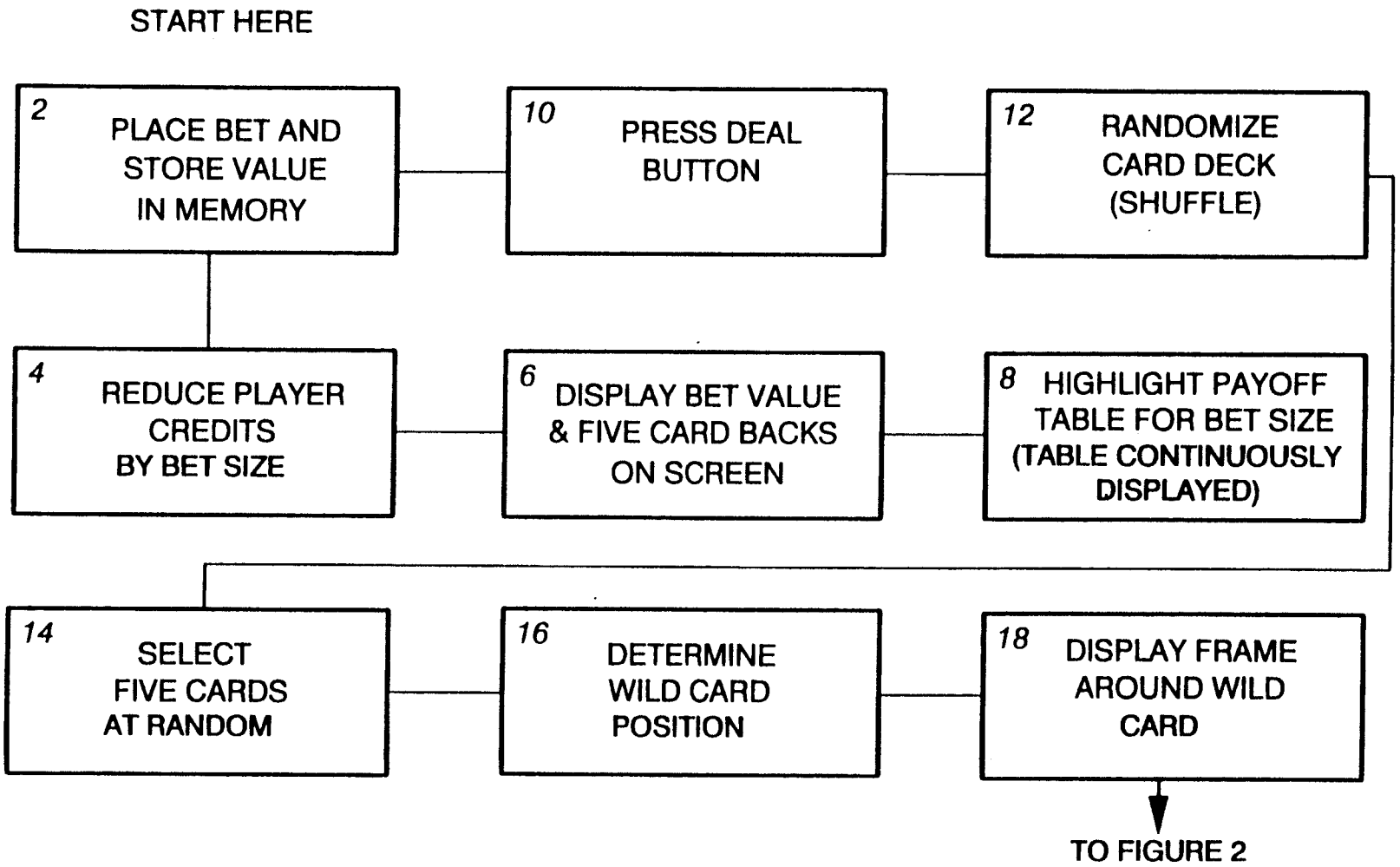
FIG. 1 is a block diagram illustrating the game's initial steps at the beginning of play.

Referring to FIG. 1, a player begins the game by placing a bet which is stored in the computer's memory 2. This is accomplished by inserting coins or betting credits into the video poker machine. The computer then reduces the player credits by the bet size 4, displays the bet size and five card backs on the screen 6 and highlights the appropriate column in the payoff table which is continuously displayed on the screen 8.

As the table below shows, the payoff increases linearly as more coins or credits are bet by the player; although bonus payoffs or progressive jackpots are certainly also within the scope of this invention. This payoff table will yield approximately a 99% long-term player return, which is consistent with other video draw poker games when employing expert play. The table would be easy to tailor if state law, for example, required lower payoff percents, since returning the player's bet for "Three Sevens Or Better" would subtract about two percent from the overall return. Moving up to "Three Eights Or Better" would subtract another two percent, etc.

SAMPLE PAYOFF TABLE

| | COINS BET | | | | |
|---|---|---|---|---|---|
| | 1 | 2 | 3 | 4 | 5 |
| Royal Flush (No Wild Cards) | 2000 | 4000 | 6000 | 8000 | 10000 |
| Four Wild Cards | 200 | 400 | 600 | 800 | 1000 |
| Royal Flush (1 Or More Wilds) | 25 | 50 | 75 | 100 | 125 |
| Five Of A Kind | 15 | 30 | 45 | 60 | 75 |
| Straight Flush | 10 | 20 | 30 | 40 | 50 |
| Four Of A Kind | 6 | 12 | 18 | 24 | 30 |
| Full House | 5 | 10 | 15 | 20 | 25 |
| Flush | 3 | 6 | 9 | 12 | 15 |
| Straight | 2 | 4 | 6 | 8 | 10 |
| Three Six's Or Better (6's thru A's) | 1 | 2 | 3 | 4 | 5 |

After the player presses a "DEAL" button 10, the machine then randomizes the card deck 12 and selects five cards from the deck 14. The machine then randomly selects which one of the five cards, by position, will be the wild card position 16. Once determined, a brightly colored frame with the word "WILD" inscribed in the frame appears around the wild card position 18.

Figure 2:
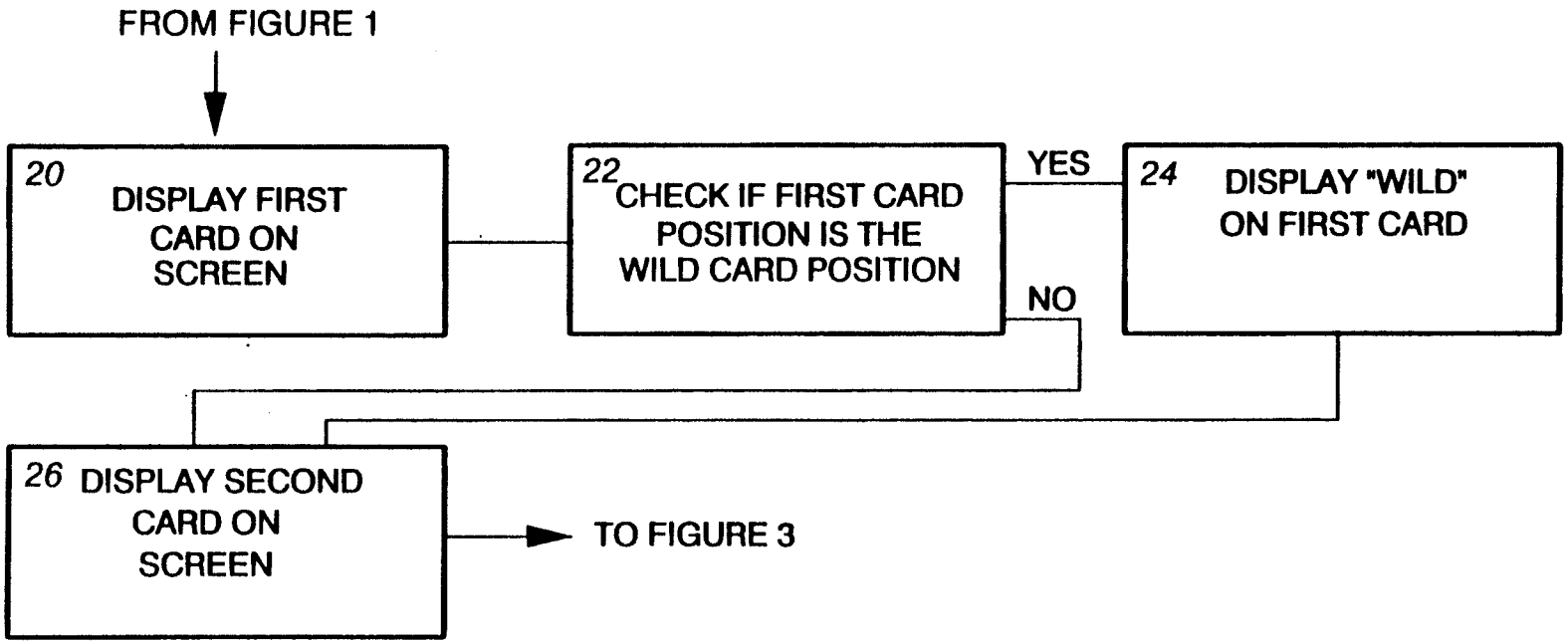
FIG. 2 is a block diagram illustrating the play sequence when the first card is displayed on the screen.

Referring to FIG. 2, the machine then proceeds to display the first card on the screen 20. The computer then checks to determine if the first card position is the wild card position 22. If it is the wild card position, the word "WILD" is displayed on the card in the upper right corner 24 and the machine then proceeds to display the second card on the screen 26. If the first card position is not the wild card position, the computer proceeds to display the second card on the screen 26.

Figure 3:
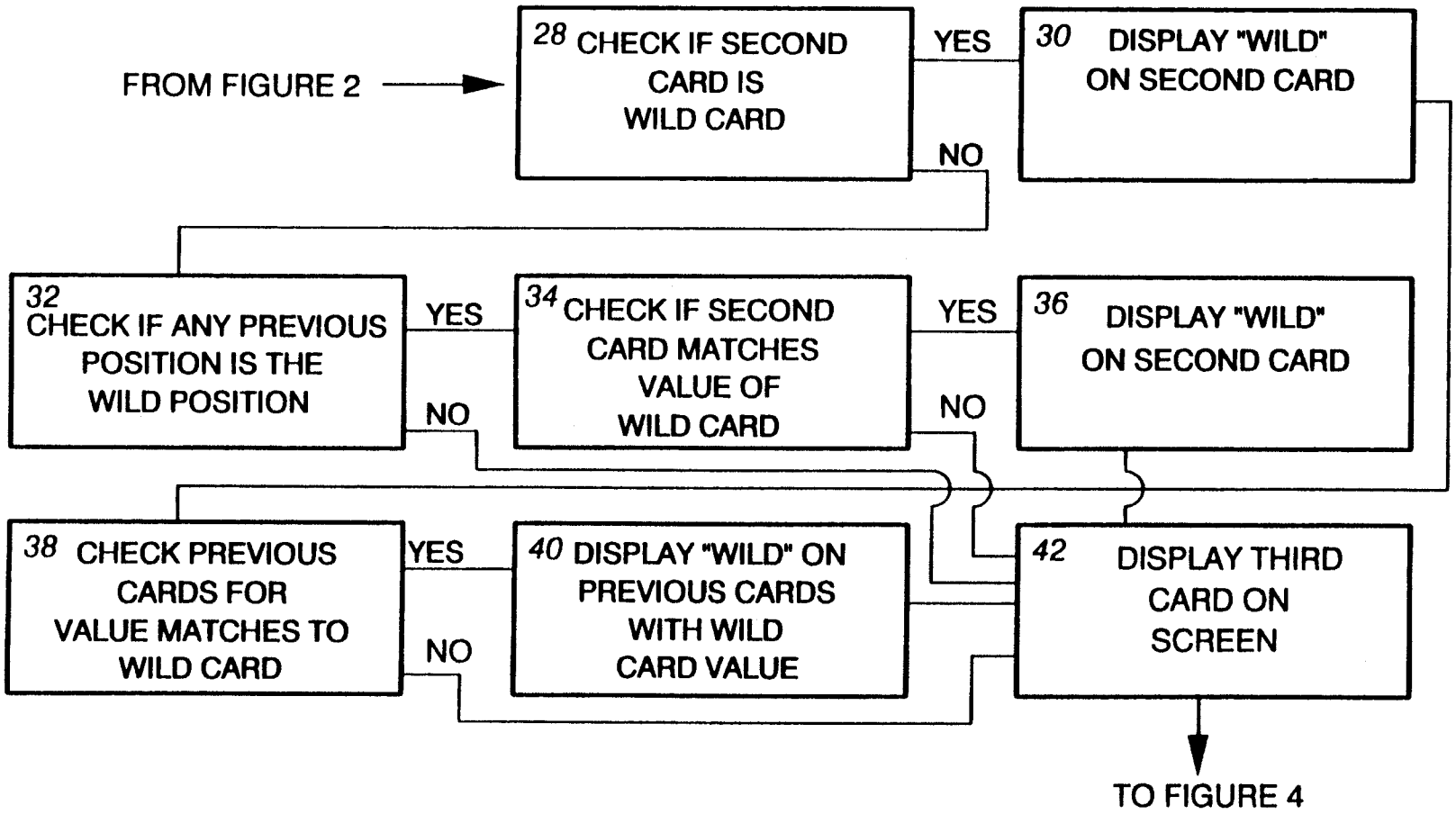
FIG. 3 is a block diagram illustrating the play sequence when the second card is displayed on the screen.

Referring to FIG. 3, the computer now checks to determine if the second card is in the wild card 28. If this is true, the word "WILD" is displayed on the second card 30 and the first card is checked to determine if it matches the wild card value 38. If this is true, the word "WILD" is displayed on the first card 40. The machine now displays the third card on the screen 42.

If the second card is not the wild card position 28, the computer checks to determine if the first card position is the wild card position 32. If this is true, the second card is checked to determine if it matches the wild card value 34. If this is true, the word "WILD" is displayed on the second card 36 and the machine then displays the third card 42. If the check of the first card position determines it is not the wild card position 32; or first card position is the wild card position but the second card does not match the wild card value 34, then the machine proceeds to display the third card on the screen 42.

Figure 4:
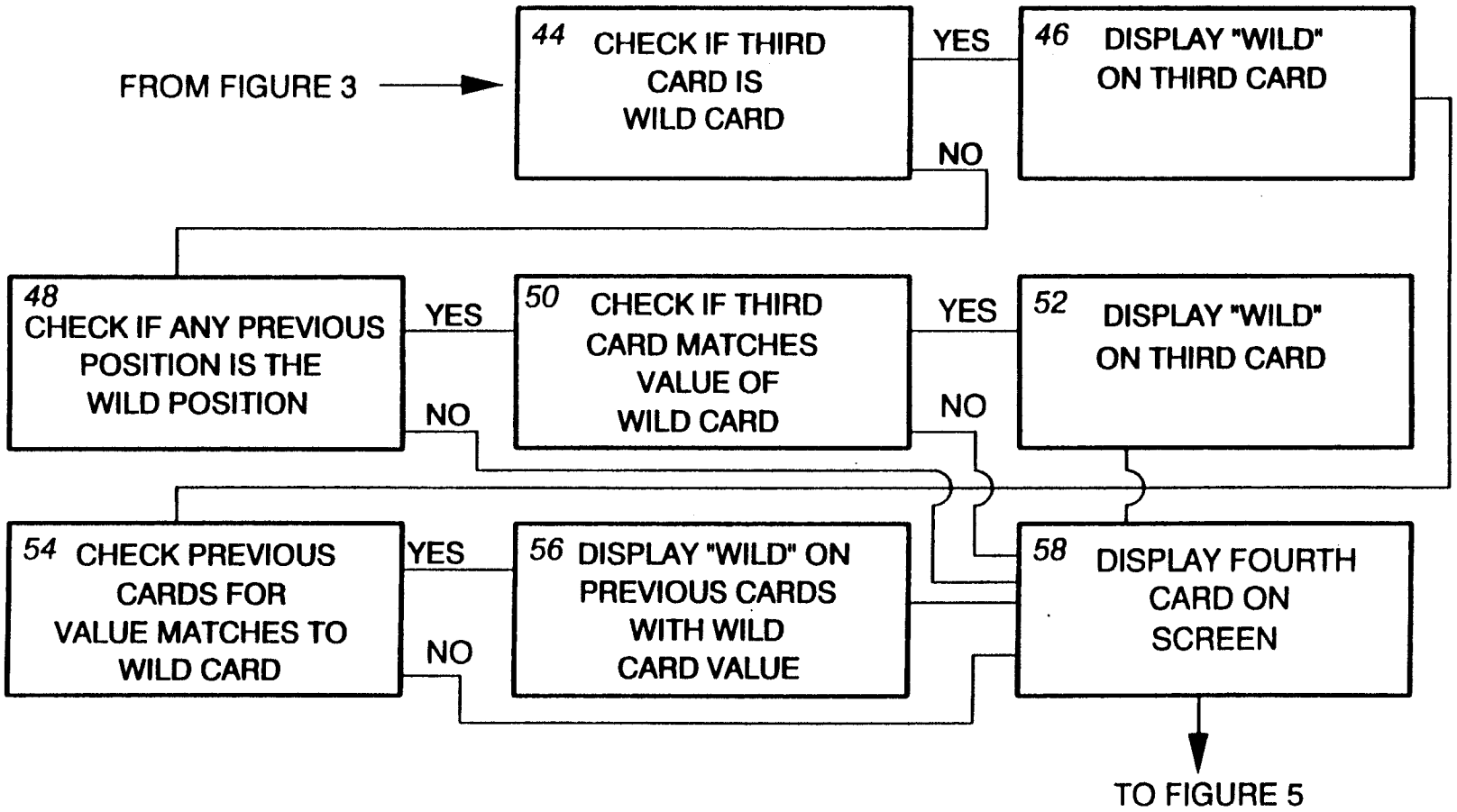
FIG. 4 is a block diagram illustrating the play sequence when the third card is displayed on the screen.

Referring to FIG. 4, the computer now checks to determine if the third card is the wild card 44. If this is true, the word "WILD" is displayed on the third card 46 and the previous cards are checked to determine if any of them match the wild card value 54. If this is true, the word "WILD" is displayed on those cards determined to be wild 56. The machine now displays the fourth card on the screen 58.

If the third card is not the wild card position 44, the computer checks to determine if any of the previous card positions are the wild card position 48. If this is true, the third card is checked to determine if it matches the wild card value 50. If this is true, the word "WILD" is displayed on the third card 52. If the check of the previous cards determines none of them to be the wild card position 48; or one of the previous card positions is the wild card position but the third card does not match the wild card value 54; then the machine proceeds to display the fourth card on the screen 58.

Figure 5:
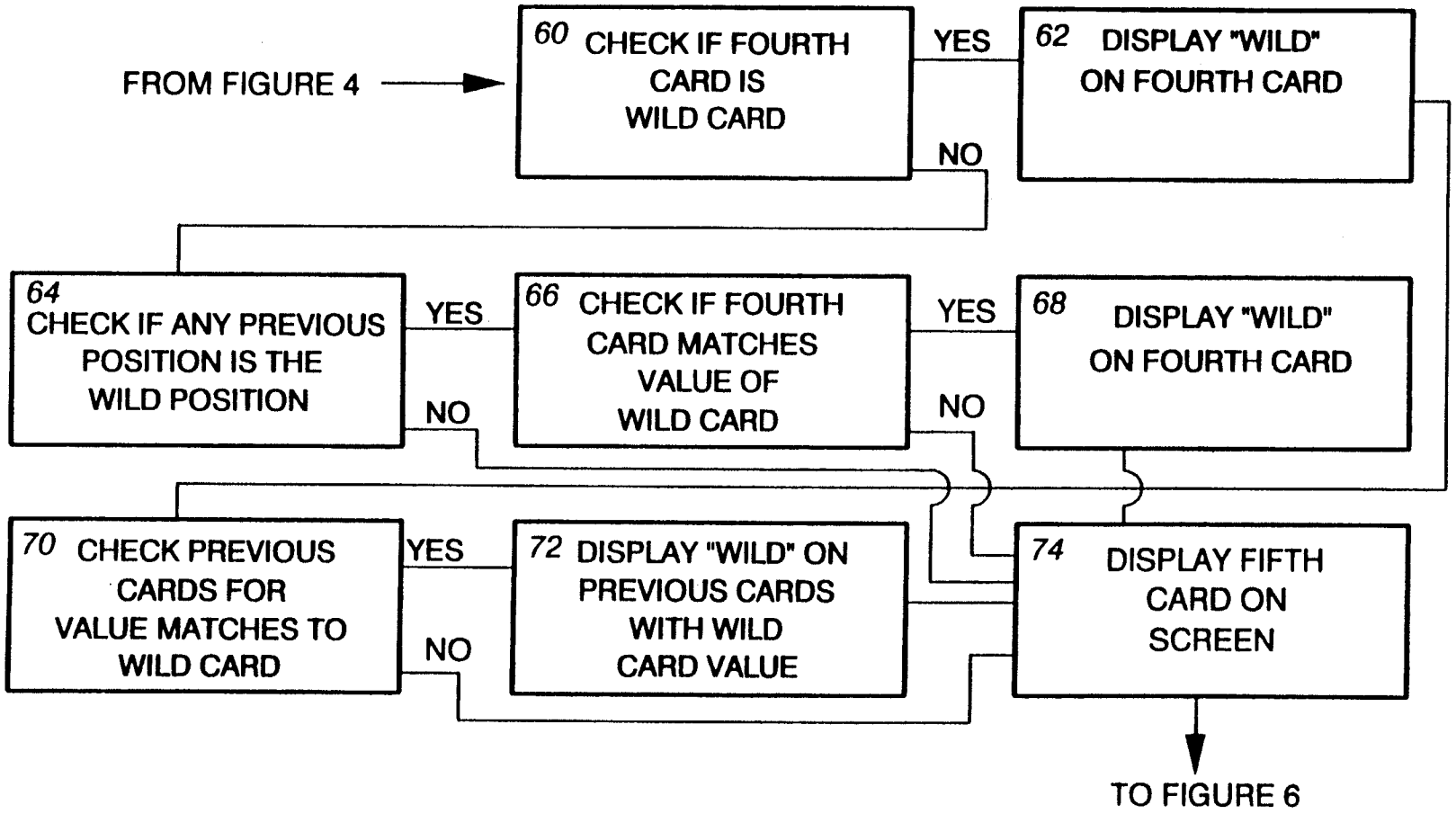
FIG. 5 is a block diagram illustrating the play sequence when the fourth card is displayed on the screen.

Referring to FIG. 5, the computer now checks to determine if the fourth card is the wild card 60. If this is true, the word "WILD" is displayed on the fourth card 62 and the previous cards are checked to determine if any of them match the wild card value 70. If this is true, the word "WILD" is displayed on those cards determined to be wild 72. The machine now displays the fifth card on the screen 74.

If the fourth card is not the wild card position 60, the computer checks to determine if any of the previous card positions are the wild card position 64. If this is true, the fourth card is checked to determine if it matches the wild card value 66. If this is true, the word "WILD" is displayed on the fourth card 68. If the check of the previous cards determines none of them to be the wild card position 64; or one of the previous card positions is the wild card position but the fourth card does not match the wild card value 66; then the machine proceeds to display the fifth card on the screen 74.

Figure 6:
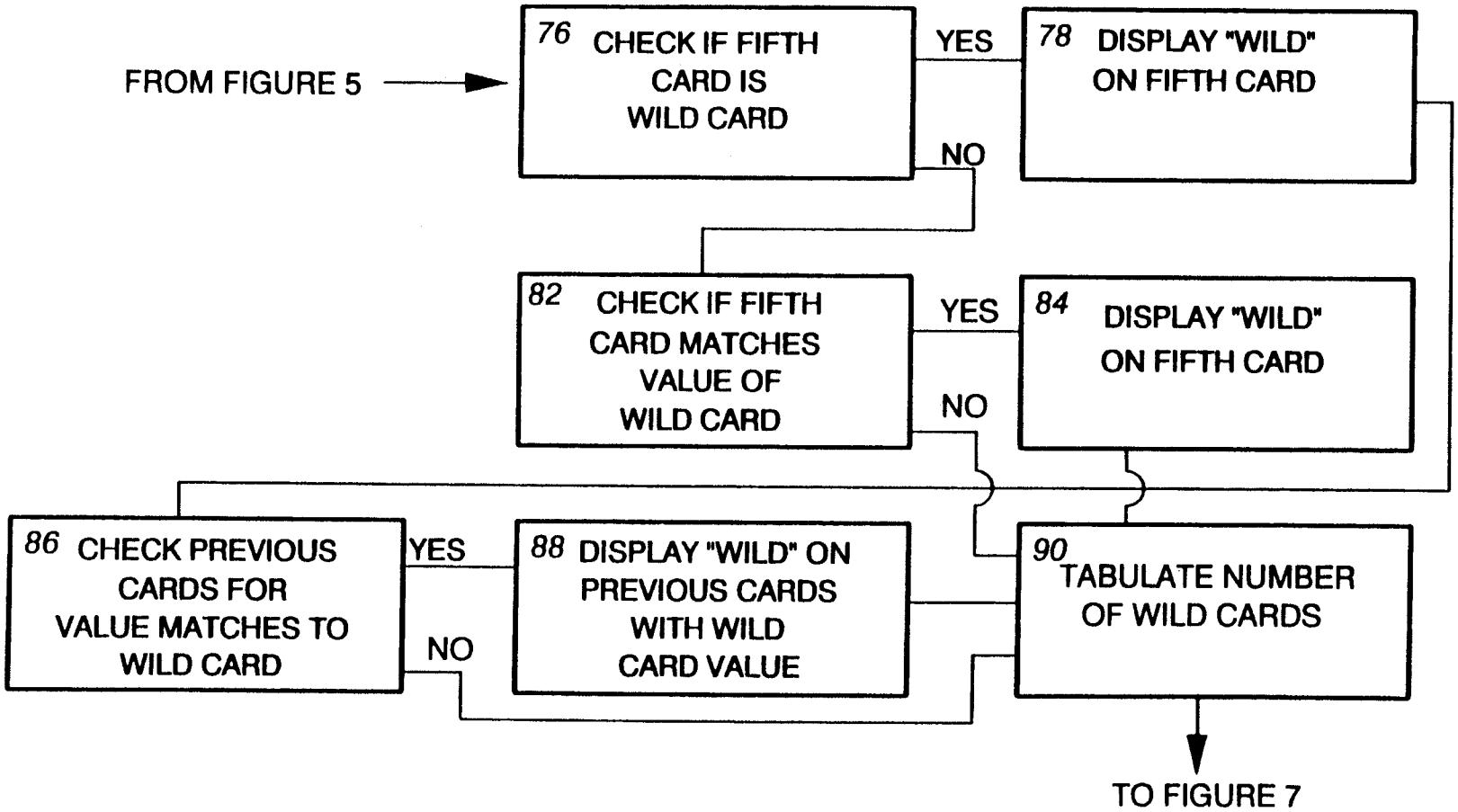
FIG. 6 is a block diagram illustrating the play sequence when the fifth card is displayed on the screen.

Referring to FIG. 6, the computer now checks to determine if the fifth card is the wild card 76. If this is true, the word "WILD" is displayed on the fifth card 78 and the previous cards are checked to determine if any of them match the wild card value 86. If this is true, the word "WILD" is displayed on those previous cards 88. The machine now tabulates the number of wild cards in the hand 90.

If the fifth card is not the wild card position 76, it is checked to determine if it matches the wild card value 82. If this is true, the word "WILD" is displayed on the fifth card 84. If the fifth card does not match the wild card value 82, then the machine proceeds to tabulate the number of wild cards in the hand 90.

Figure 7:
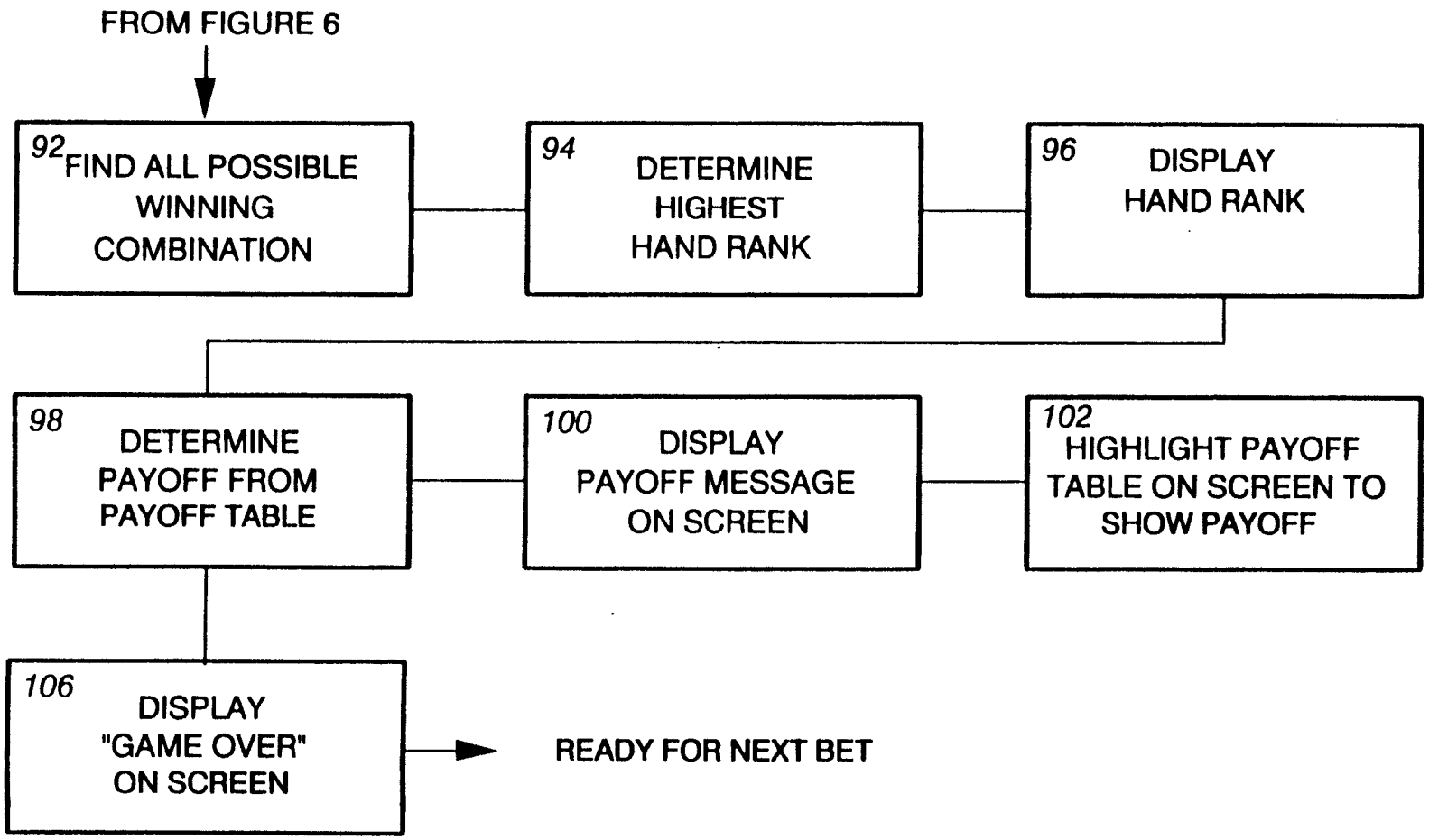
FIG. 7 is a block diagram illustrating the sequence of action after the hand is complete, including evaluation, payment, and winning messages.

Referring to FIG. 7, the computer then finds all winning hand combinations 92. Then the highest ranking of the winning hands is selected for payoff 94. The rank of this hand is displayed on the screen 96. The payoff is then determined from the payoff table 98 stored in the computer's memory, using the bet value 2 and the hand rank 94 as indices to the table. The payoff message is displayed on the screen 100 and the payoff table on the screen is highlighted appropriately 102. Finally, a "GAME OVER" message is displayed on the screen 106 until the player places the next bet.

What is claimed is:

1. A method for playing a game of poker, using game apparatus selected from the group that includes, first, playing cards and, second, a computer for playing a video card game, along with a video screen and a means to receive and dispense tokens, comprising the steps of:

(a) receiving and storing a bet from a player, (b) receiving a signal means from the player to begin play of the hand, (c) displaying a payoff table, (d) displaying a plurality of card positions to the player with each position corresponding to a card which will become part of the player's hand, (e) determining, by a selection means, which single card position out of the plurality of positions will be the wild card position for the hand, (f) indicating to the player, by a communication means, the wild card position selected in step (e), (g) determining, by a selection means, the player's hand of cards which consist of the plurality of cards, referred to in step (d), selected from a deck of cards or from two or more combined decks of cards, (h) displaying the plurality of cards selected in step (g) to the player in a manner such that each of the cards coincides with one of the card positions displayed in step (d), (i) indicating to the player, by a communication means, that the card displayed in the wild card position, and all other cards in the hand that match the value of the wild card, are wild cards, (j) determining a rank value of the poker hand using the wild card, and any additional cards discovered via step (i) to be wild, to maximize the rank value, (k) determining a payoff from the payoff table in step (c) using the rank value determined in step (j) and the amount of the bet received in step (a) as indices to the payoff table, (l) awarding a payoff to the player as determined in step (k), (m) in successive hands, steps (a) through (l) are repeated; whereas the player's enjoyment is substantially increased as newly determined wild card positions are indicated in step (f) and newly chosen wild cards are displayed in the newly determined positions in step (h).

2. The method of claim 1 wherein the wild card position determined in step (e) is determined by a random selection means.

3. The method of claim 1 wherein the wild card position determined in step (e) is determined by player selection.

4. The method of claim 1 wherein the wild card position determined in step (e) is determined from one hand to the next according to a predetermined set of selection instruction means which are displayed for viewing by all involved in the game.

5. A method for playing a video poker game using a computer and a video monitor comprising the steps of:

(a) receiving a bet value from a player, (b) storing the bet value in the computer memory, (c) displaying the bet value on the video screen, (d) displaying a payoff table, using a display means, for the player to view and storing the payoff table in the computer memory, (e) displaying on the video screen a plurality of card positions with each position corresponding to a card which will become part of the player's hand, (f) determining, by a selection means, which card position out of the plurality of positions will be the wild card position for the hand, (g) displaying on the video screen the wild card position selected in step (f), (h) determining, through a selection means, the player's hand consisting of the plurality of cards, referred to in step (e), selected from a deck of cards or from two or more combined decks of cards, (i) displaying the plurality of cards selected in step (h) on the video screen in a manner such that each of the cards coincides with one of the card positions displayed in step (e), (j) visually marking on the video screen the card located in the wild card position, as determined in step (f), as a wild card, (k) inspecting all other cards in the hand, by means of the computer microprocessor, to determined if their value matches the value of the wild card, (l) visually marking on the video screen any cards found in step (k) to match the value of the wild card as wild cards, (m) determining a rank value of the poker hand using the wild card, and any additional cards discovered via step (k) to be wild, to maximize the rank value, (n) determining a payoff from the payoff table stored in the computer memory in step (d) using the rank value determined in step (m) and the bet value stored in the computer memory in step (b) as indices to the payoff table, (o) displaying on the video screen the payoff to the player as determined in step (n).

6. The method of claim 5 wherein the wild card position determined in step (f) is determined by a random selection means.

7. The method of claim 5 wherein the wild card position determined in step (f) is determined by player selection.

8. The method of claim 5 wherein the wild card position determined in step (f) is determined by the computer, from one hand to the next, according to a predetermined set of selection instruction means stored in the computer memory and displayed, using a display means, for viewing by the player.

9. A method for playing a table poker game, involving a dealer, playing cards and a table occupied by one or more players, comprising the steps of:

(a) the dealer receiving bets from each player and displaying their values by a display means, (b) displaying a payoff table, by a display means, for viewing by the players and the dealer, (c) displaying on the table, for each player, a plurality of card positions with each position corresponding to a card which will become part of that player's hand, (d) determining, by a selection means, which card position out of the plurality of positions for each player will be the wild card position for that player, (e) the dealer displaying to the players, by a display means, the wild card position selected in step (d) for each player, (f) dealing, by means of the dealer, the plurality of cards, referred to in step (c), to form each player's hand from a deck of cards, or from multiple combined decks of cards, in a manner such that each card is placed on one of the card positions displayed in step (c), (g) indicating, by a communication means, that the card located in each player's wild card position, and all other cards in each player's hand that match the value of that player's wild card, are wild cards, (h) the dealer determining a rank value for each player's hand, using the wild card and any additional cards discovered via step (g) to be wild, to maximize the rank value, (i) the dealer determining a payoff for each player's hand from the payoff table in step (b) using the rank value determined in step (h) and the bet value displayed in step (a) as indices to the payoff table, (j) the dealer awarding a payoff to each player as determined in step (i).

10. The method of claim 9 wherein the wild card position determined in step (d) is determined by the dealer operating a random selection means.

11. The method of claim 9 wherein the wild card position determined in step (d) is determined by a player operating a random selection means.

12. The method of claim 9 wherein the wild card position determined in step (d) is selected by each player for that player's own hand.

13. The method of claim 9 wherein the wild card position determined in step (d) is determined for all players by a single player, who is identified according to a predetermined selection means which has been displayed for viewing by the players and the dealer.

14. The method of claim 9 wherein the wild card position determined in step (d) is determined by the dealer systematically following a predetermined set of selection instruction means which are displayed for viewing by the players and the dealer.

* * * * *